US005474203A

United States Patent [19]

Baker

[11] Patent Number: 5,474,203

[45] **Date of Patent: *Dec. 12, 1995**

[54] PAPERBOARD CONTAINER FOR FLUIDS HAVING TOP OPENING FITMENT AND EXPOSED LIP FOR ENGAGEMENT BY HANDLING IMPLEMENTS

[75] Inventor: Harold L. Baker, Longview, Wash.

[73] Assignee: Longview Fibre Company, Longview, Wash.

[ * ] Notice: The term of this patent shall not extend beyond the expiration date of Pat. No. 5,348,186.

[21] Appl. No.: 308,285

[22] Filed: Sep. 19, 1994

Related U.S. Application Data

[63] Continuation-in-part of Ser. No. 41,756, Apr. 2, 1993, Pat. No. 5,348,186.

[51] Int. Cl.[6] ..... B65D 5/56; B65D 5/72

[52] U.S. Cl. ..... 220/465; 222/105; 222/183; 222/541.1

[58] Field of Search ..... 222/105–107, 222/183, 320, 321, 541, 544, 562, 566; 220/462, 465

[56] References Cited

U.S. PATENT DOCUMENTS

| | | | |
|---|---|---|---|
| Re. 33,128 | 12/1989 | Nordstrom . | |
| 3,007,608 | 11/1961 | Cox, Jr. | 220/465 |
| 3,219,240 | 11/1965 | Campbell, Jr. | 222/541 |
| 3,937,392 | 2/1976 | Swisher . | |
| 3,972,454 | 8/1976 | Croley . | |
| 4,166,567 | 9/1979 | Beach, Jr. et al. . | |
| 4,359,182 | 11/1982 | Perkins, Jr. . | |
| 4,392,607 | 7/1983 | Perkins, Jr. . | |
| 4,421,253 | 12/1983 | Croley . | |
| 4,516,692 | 5/1985 | Croley | 222/105 |
| 4,524,883 | 6/1985 | Herring | 220/465 |
| 4,623,075 | 11/1986 | Riley | 222/105 |
| 4,771,917 | 9/1988 | Heaps, Jr. et al. | 222/541 |
| 4,850,506 | 7/1989 | Heaps, Jr. et al. . | |
| 4,930,661 | 6/1990 | Voorhies | 220/465 |
| 5,069,359 | 12/1991 | Liebel | 222/105 |
| 5,348,186 | 9/1994 | Baker | 220/465 |

*Primary Examiner*—Gary E. Elkins
*Attorney, Agent, or Firm*—Chernoff, Vilhauer, et al.

[57] ABSTRACT

A paperboard container for storing and transporting fluids has a tubular shell formed from interfitting inner and outer shell pieces. The shell is enclosed at its bottom end by a base having projecting flaps which are sandwiched between the shell pieces and flaps located at the bottom of the outer shell cover the base. A flexible liner located in the shell has a fitment at its upper end which permits the liner to be filled and emptied. The top of the shell is covered with inner cap and a closure means which are separated from one another and contain aligned openings which the fitment passes through. A fitment lock, which immovably engages the fitment, fits between the inner cap and closure means and is adhesively affixed to at least one of them. The fitment lock, and the inner cap and closure means act in conjunction to prevent movement of the fitment and to provide the lateral and longitudinal stability necessary to permit a hand pump to be installed in the fitment. Openings located around the periphery of the closure means expose portions of the shell sidewall between the inner cap and closure means which can be engaged by the beak of an implement handling apparatus.

12 Claims, 10 Drawing Sheets

PAPERBOARD CONTAINER FOR FLUIDS HAVING TOP OPENING FITMENT AND EXPOSED LIP FOR ENGAGEMENT BY HANDLING IMPLEMENTS

RELATED APPLICATIONS

This application is a continuation-in-part of application Ser. No. 08/041,756 filed Apr. 12, 1993, now U.S. Pat. No. 5,348,186 issued Sep. 20, 1994.

BACKGROUND AND SUMMARY OF THE INVENTION

This invention relates to a paperboard container for fluids and in particular to such a container where the fitment used to fill and empty the container is located at its top, and the container has a top rim that will accommodate drum handling devices.

Paperboard containers having flexible, liquid impervious liners are becoming more widely used as a substitute for steel drums. Not only are paperboard containers easily disposed of in an environmentally safe manner when their use is completed, they can be shipped unassembled at a much lower cost than steel drums. Such containers are disclosed in Nordstrom, U.S. Pat. Re. 33,128; Heaps, Jr. et al., U.S. Pat. No. 4,850,506; Heaps, Jr. et al., U.S. Pat. No. 4,771,917; and Croley, U.S. Pat. No. 4,421,253.

Prior art paperboard containers have two shortcomings which prevent their use as a substitute for steel drums in many applications. Thus, their acceptance has been limited. Many products, particularly petroleum products, are pumped out of steel drums by mounting a hand operated pump in the threaded hole located in the lid of the drum. Operation of this pump transmits substantial forces to the lid. With paperboard containers a plastic fitment, which is fluidly connected to the liner, opens out of the container to permit filling and emptying of the container. This fitment is attached to the container by a fitment lock. In prior art containers of this type neither the top of the container nor the fitment lock is capable of carrying the loads associated with the operation of a hand pump. As a result, the fitment exits through the side rather than through the top of the prior art containers.

A second shortcoming with paperboard containers that prevents their being fully accepted as a replacement for steel drums is that they do not have a rim at their top edge that can be engaged by drum handling implements. These implements, such as rocker dollies and drum handling carts, have forks which fit under the drum and a "beak" which engages the rim of the drum. When installed they become rigidly attached to the drum and facilitate its movement. With paperboard containers a rim which projects unprotected above the top of the container would be easily damaged and in the process possibly compromise the integrity of the container.

The subject invention overcomes the foregoing limitations and shortcomings of the prior art paperboard containers by providing an upright tubular shell that is covered at its bottom and contains a flexible impervious liner. The top of the container is enclosed by an inner cap and outer closure means which are separated from the inner cap. Located around the periphery of the closure means are openings that abut the sidewall of the shell. Since there is a space between the inner cap and closure means, the sidewall of the shell is exposed below these openings and can be engaged by drum handing implements. However, because the openings only exposed short segments of the sidewall, the majority of the sidewall remains protected by the closure means and the sidewall is not readily subject to damage. In addition, the two layers provided by the inner cap and closure means supports the sidewall against lateral loading imparted by the implement, and prevents the liner from being damaged by drum handling implements.

In a preferred embodiment the inner cap and closure means have aligned holes through which the fitment extends. A fitment lock located between the inner cap and closure means engages the fitment and prevents its movement.

In one embodiment the fitment lock is a piece of paperboard which is folded into several overlapping flaps. Some of the flaps contain a rectangular opening which snugly engages the locking portion of the fitment and prevents the fitment from moving in a direction parallel with the axis of its passageway. Other flaps contain circular openings which snugly engage the neck of the fitment and prevent the fitment from moving in a direction perpendicular with its axis. With this embodiment the fitment lock preferably is adhesively attached to both the inner cap and closure means. In another embodiment the fitment lock is a block of wood having a thickness equal to the height of the locking portion of the fitment and containing a rectangular slot that engages the locking portion of the fitment. In this embodiment the fitment lock may be adhesively attached only to the inner cap.

The invention will be more readily understood upon consideration of the following detailed description of the invention, taken in conjunction with the accompanying drawings.

DETAILED DESCRIPTION OF A PREFERRED EMBODIMENT

Figure 1:
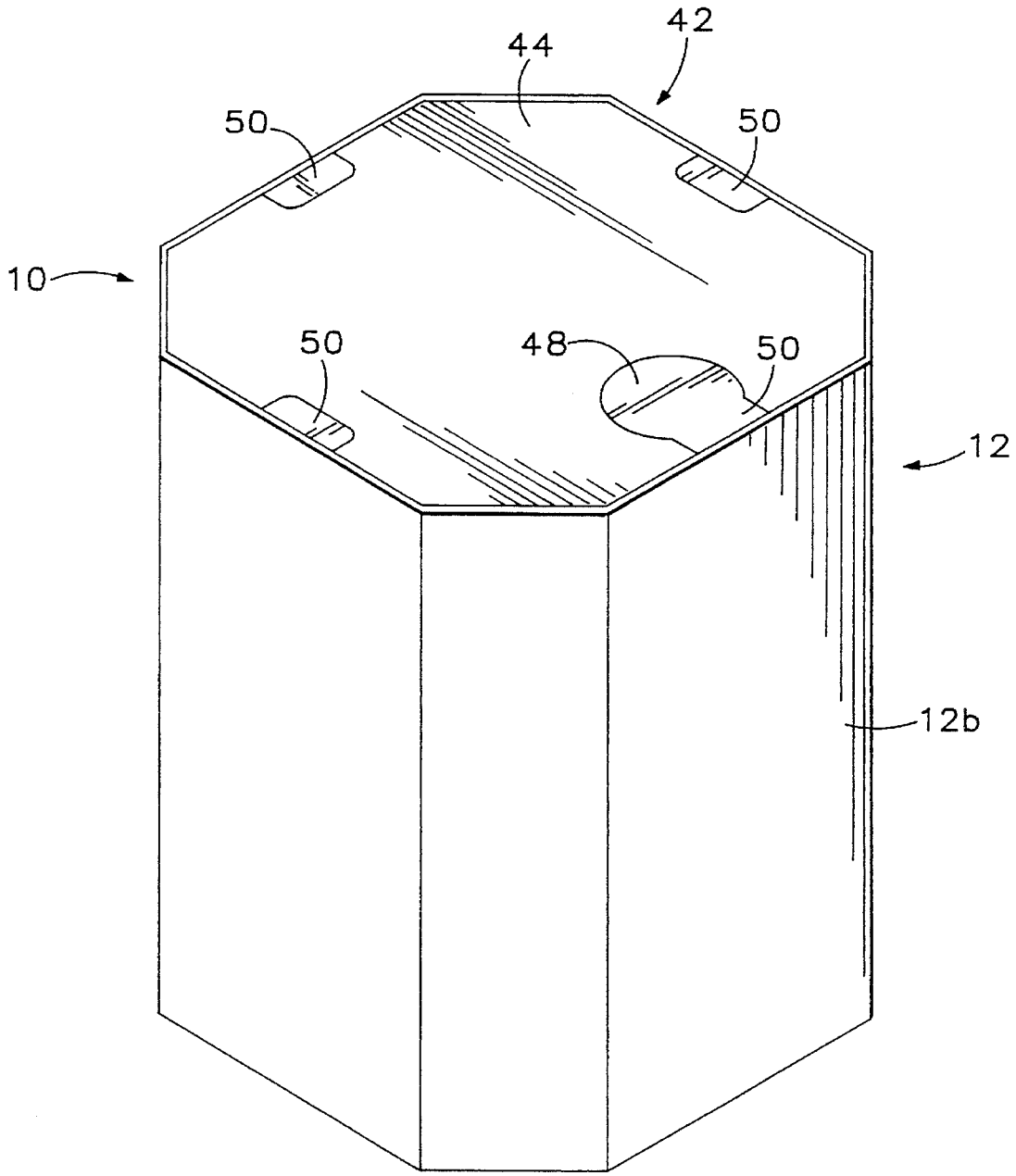
FIG. 1 is a perspective view of a container embodying the subject invention.
Figure 2:
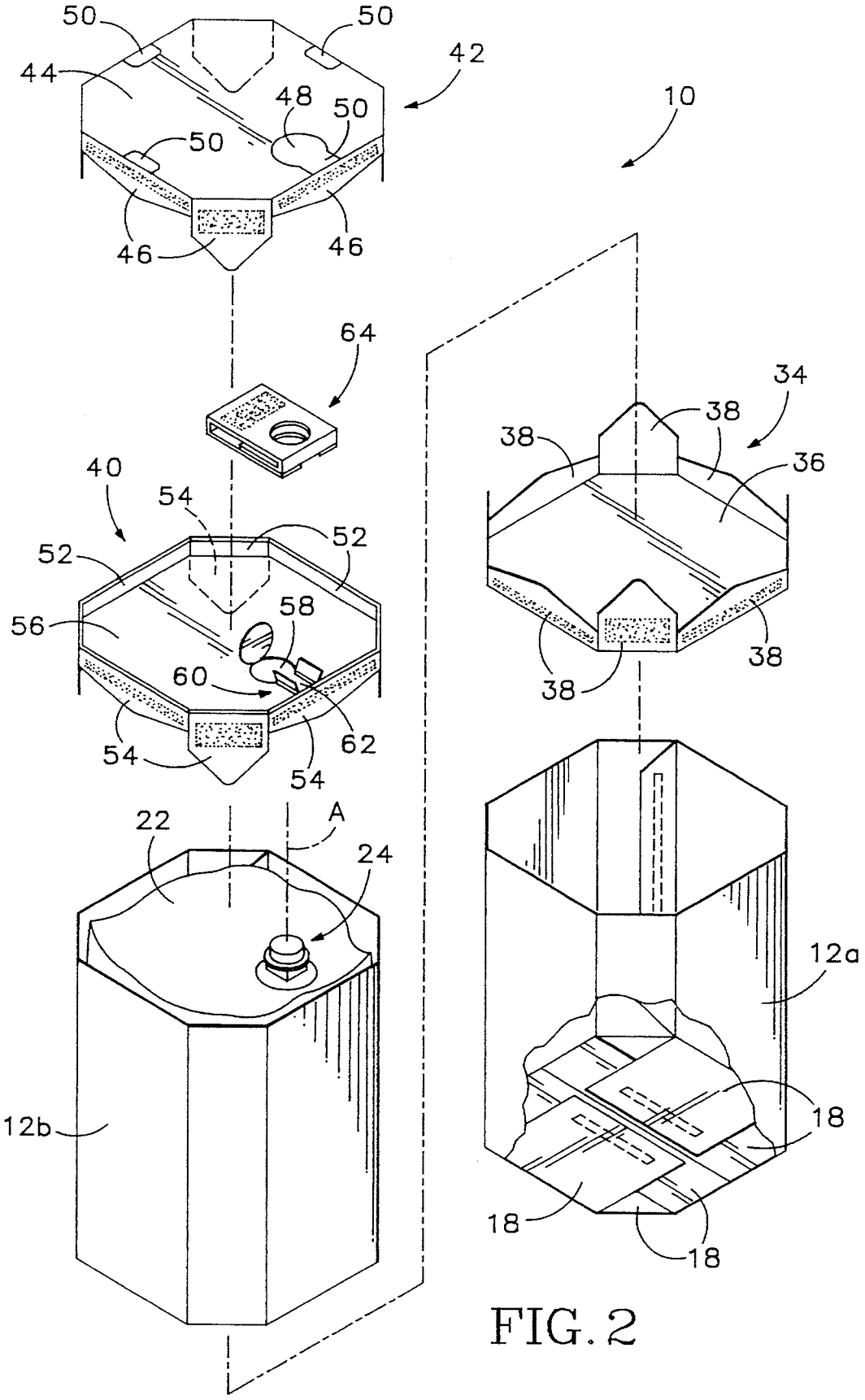
FIG. 2 is an exploded perspective view of the container of FIG. 1, at a smaller scale.
Figure 3:
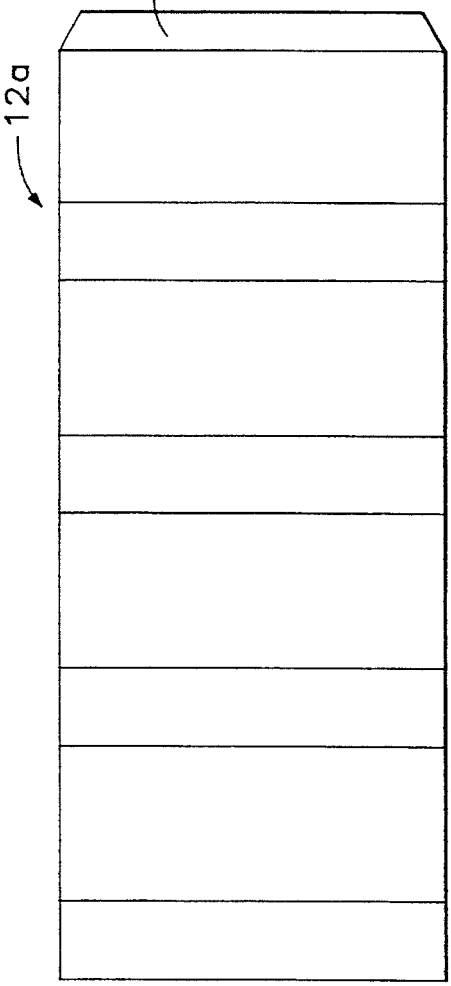
FIG. 3 is a plan view of the inner shell of the container.
Figure 4:
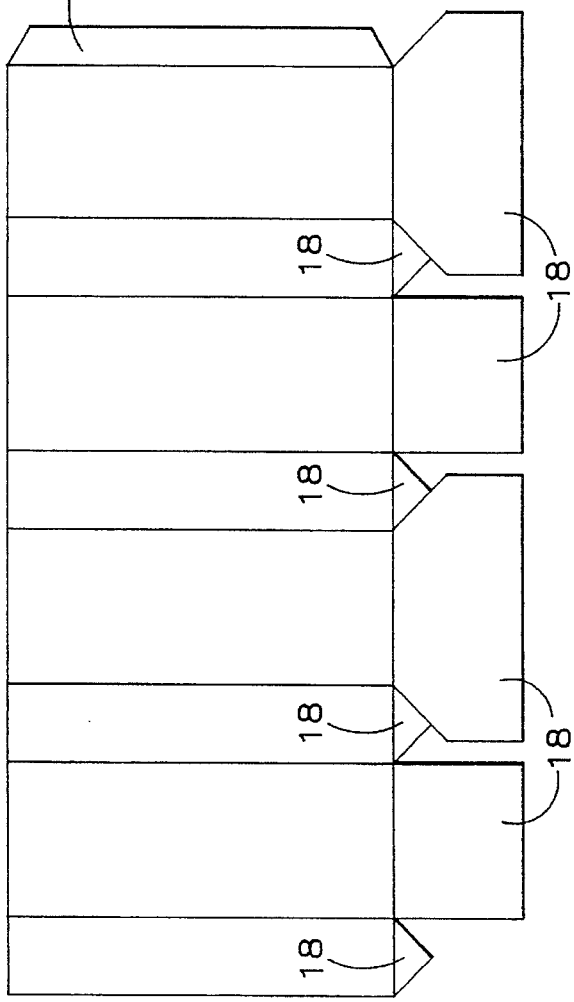
FIG. 4 is a plan view of the outer shell of the container.
Figure 6:
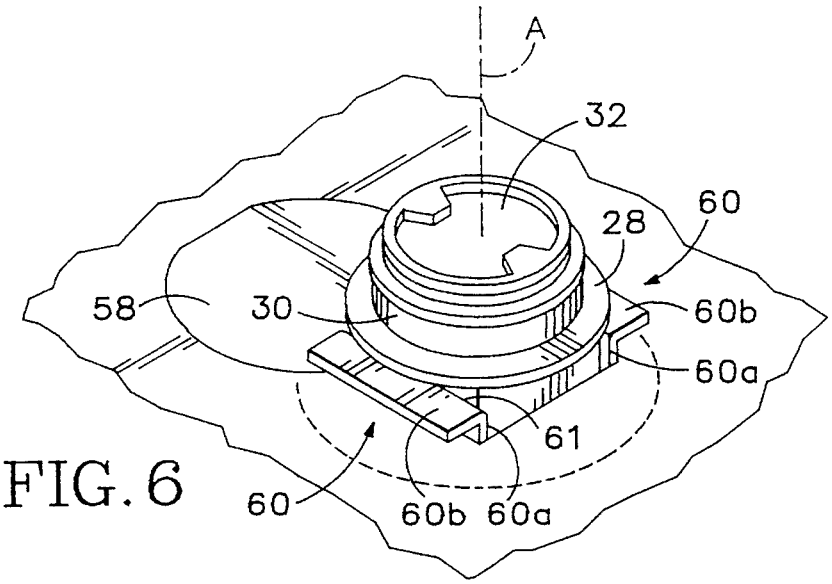
FIG. 6 is a fragmentary perspective view at an enlarged scale, showing the details of the fitment located in the container liner.

Referring now to FIGS. 1 and 2 of the drawings, a container 10 embodying a preferred embodiment of the subject invention comprises a hollow cylindrical shell 12 which is open at both ends. In the embodiment illustrated, the shell includes an inner shell piece 12*a* and an outer shell piece 12*b* which tightly overlie one another. Preferably the shell pieces are made from a foldable biodegradable material, such as paperboard, which allows them to be shipped flat and recycled after the resulting container has been used. Since the shell pieces are the primary support elements they should be corrugated to provide maximum stiffness. The shell pieces are made from blanks having fold lines placed in them (FIGS. 3 and 4). The blanks have a tab 14 at one side which is attached to the outermost panel 16 at the opposite side by an appropriate adhesive. The shell shown in the drawings has a modified octagonal shape when erected with four short sides and four long sides. Other polygonal or modified polygonal shapes could also be utilized.

Figure 10:
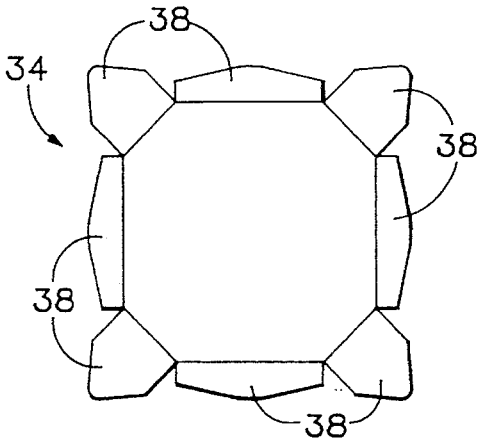
FIG. 10 is a plan view of the base of the container.

The bottom of the shell is covered with a base 34, FIG. 10, which also is made from a paperboard blank. However, the base requires toughness, puncture resistance and flexibility rather than stiffness, so it preferably is solid fiber rather than corrugated. The base has a center section 36 with the same modified octagonal shape as the shell. Flaps 38, which extend outwardly from each facet of the center section 36, are folded perpendicular to the center section, and inserted between the inner and outer shell pieces 12*a* and 12*b*. In the embodiment illustrated the flaps adjacent to the longer facets of the center section are shorter than the flaps adjacent to the shorter facets. Adhesive may be placed between the flaps and the shell pieces. The outer shell piece 12*b* has flaps 18 at one end which fold over the base 34 to strengthen the bottom of the container. The flaps 18 are arranged to overlie one another so as to completely cover the base. In the embodiment illustrated, an adhesive is placed between the flaps and between the flaps and the base to hold the flaps in place. Alternately, the flaps could be secured by staples or tape or could be of a self-locking design.

Figure 5:
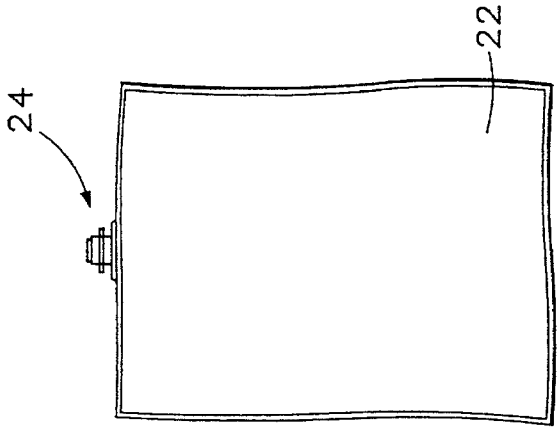
FIG. 5 is a side elevation view of the liner of the container.

Located within the container is an enclosed polyethylene liner 22, FIG. 5, which is compatible with the material which will be carried in the container. The liner has a fitment 24 at its upper end which allows access to the liner for filling and emptying the container. As can be best seen in FIGS. 6–9, the fitment includes a locking portion 26, located adjacent to the liner, which is rectangular in cross-section with parallel spaced-apart outer walls. The locking portion 26 is located between a pair of flanges 28 which define its height. Located outwardly of the locking portion 26 is a neck portion 30 which is circular in cross-section. A cylindrical passageway (not shown) having a central axis A extends through the fitment. The upper extremity of the passageway is threaded and a cap 32, having mating threads, is placed in the passageway to enclose it. Fitments of this type are commercially available and are referred to in the trade as Waddington and Duvall, or Hedwin type fitments.

Figure 11:
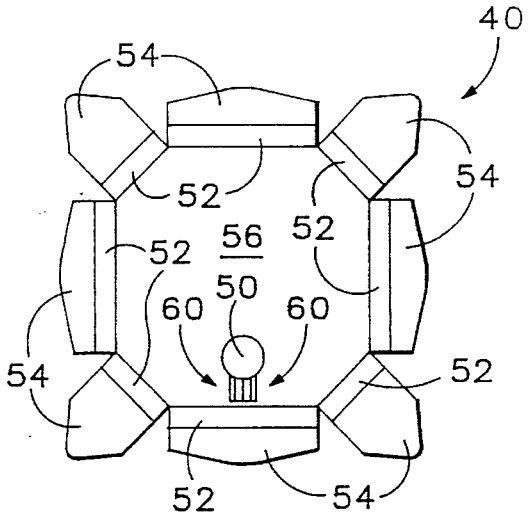
FIG. 11 is a plan view of the inner cap of the container.
Figure 12:
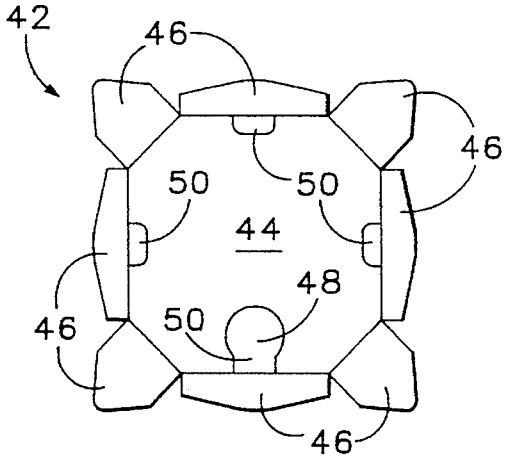
FIG. 12 is a plan view of the outer cap of the container.

The upper end of the shell is covered with an inner cap 40, FIG. 11, and an outer cap 42, FIG. 12, which also are made from solid fiber paperboard blanks. The outer cap 42 has a center section 44 and flaps 46 which are identical to the base 34. Located inwardly from one of the longer facets of the center section 44 is a circular opening 48 which the fitment 22 can be accessed. Located along the intersection of the longer facets of the center section 44 and the flaps 46 are generally rectangular openings 50. One of the rectangular openings 50 is located adjacent the circular opening 48 and opens into it. The openings 48 and 50 are stamped in the outer cap blank when it is made but generally are not removed until the container is placed in use. Thus, the fitment is covered which prevents its being prematurely opened. The outer cap 42 is installed at the upper end of the shell in the same manner as the base is installed at the lower end of the shell.

The inner cap 40 is similar to the outer cap 42 except that rectangular spacers 52 are located between each flap 54 and the center section 56. Thus, as can be best seen in FIG. 2, the center section 56 of the inner cap 40 is offset inwardly from the center section 44 of the outer cap 42. The inner cap has a circular opening 58, which is aligned with the opening 48 in the outer cap. In addition, flaps 60 are formed in the center section 56 adjacent to the opening 58 which fold up to create a rectangular opening 62 which is connected to the opening 58, FIGS. 2 and 6. Each flap 60 is divided into an inner section 60*a* and an outer section 60*b* by a pair of fold lines 61. Flap sections 60*a* have a width equal to the height of the locking portion 26 of the fitment 24. In use, the flaps are bent upwardly to create the rectangular opening 62 and the outer sections 60*b* are bent back horizontally along the fold lines 61 to where they overlie the locking flap 66 of the fitment lock 64 (which will be described below) to provide additional support for the fitment. The fitment 24 is then inserted through the circular opening 58 and the locking portion 26 is pulled back into the rectangular opening 62 where it is engaged by the bent-over flaps to lock it in place.

Figure 7:
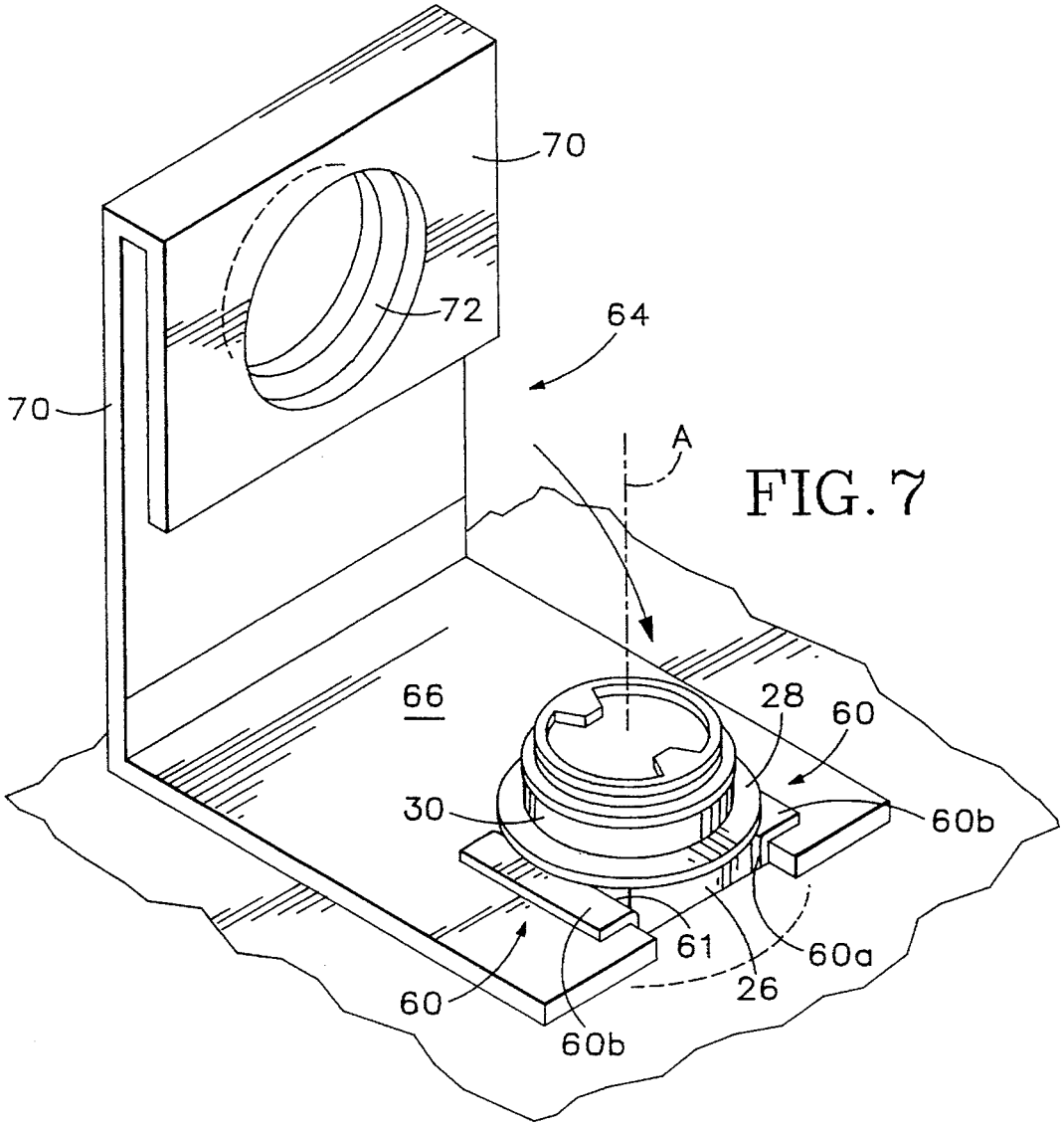
FIG. 7 is a fragmentary perspective view, similar to FIG. 6, showing a first embodiment of a fitment lock.
Figure 13:
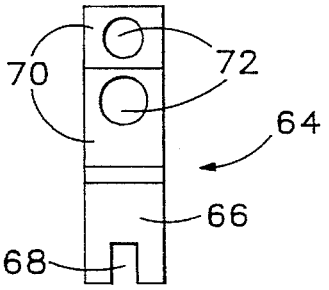
FIG. 13 is a plan view of the fitment lock shown in FIG. 7, at a smaller scale.

The fitment 24 is held in place immediately below the opening 48 in the outer cap 42 by means of a fitment lock 64, FIGS. 7 and 13. The fitment lock 64 is formed from a rectangular paperboard blank which is folded over on top of itself to provide three flaps. The fitment lock preferably is corrugated to provide a maximum stiffness. The lowermost flap is a locking flap 66 and has a rectangular slot 68 opening out of its end which snugly receives the locking portion 26 of the fitment. The remaining flaps are engagement flaps 70 and have aligned openings 72 which snugly receive the neck 30 of the fitment. The fitment lock fills the space between the inner and outer caps and is in contact with both. Preferably it is attached to both of the caps with an adhesive.

Figure 8:
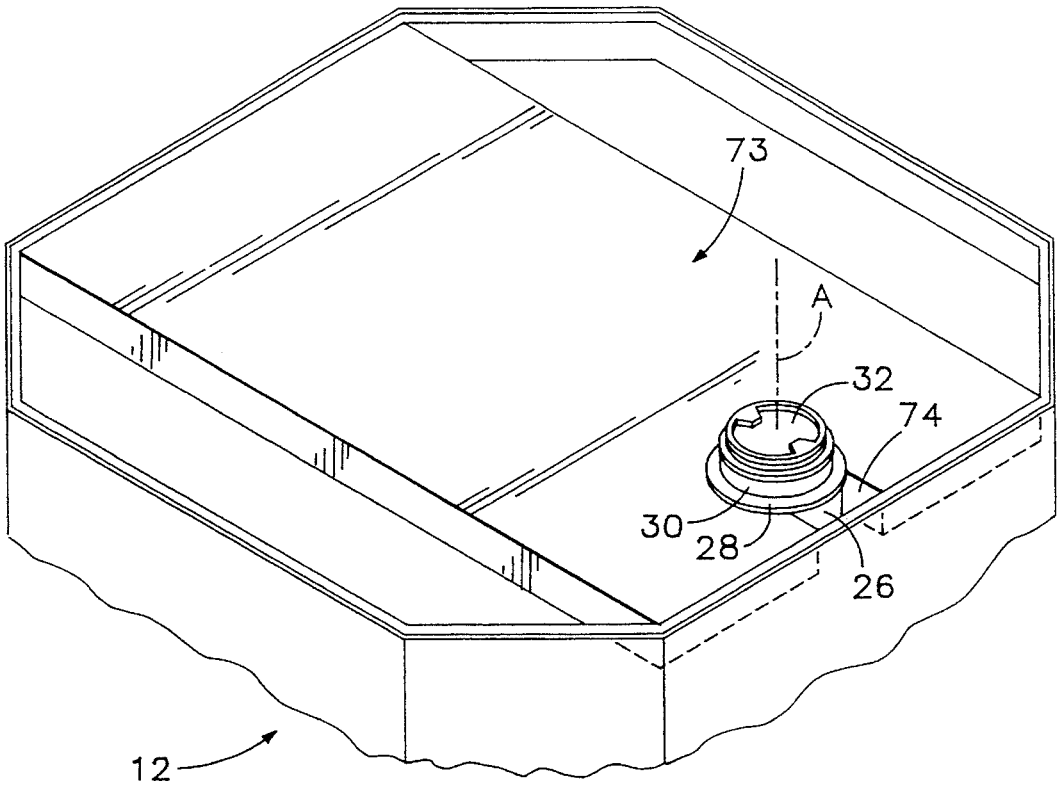
FIG. 8 is a fragmentary perspective view, similar to FIG. 6, showing a second embodiment of the fitment lock.

Alternatively, the fitment could be a single block 73, FIG. 8, which has a thickness equal to the height of the locking portion of the fitment. A rectangular slot 74 opens out of the end of the block in the same manner as the slot 68 does in the fitment lock 64. When the solid block fitment lock 73 is used the flaps 60 are not folded along the fold lines 61 but are merely folded over 180° against the inner cap. Thus, the slot 74 in the block 73 is slightly narrower than the slot 68 in the paperboard fitment lock 64. Preferably, the block extends across the entire top of the container and has a width equal to the length of the larger facets of the shell in order to provide maximum stability. Since the block does not contact the outer cap it may only be adhesively affixed to the inner cap. With either embodiment the fitment lock prevents the fitment from moving either transversely to or parallel with the central axis A of the fitment. In addition, the fitment lock provides both transverse and axial support against loads applied to the fitment. As a result, a hand pump can be installed in the fitment and operated without collapsing the caps.

The openings 50 in the outer cap 42, in conjunction with the space between the inner and outer caps, permits standard barrel handling implements, such as a rocker dolly or a drum handling cart, to be used with the container. The portion of the shell exposed by the openings 50 serves as a lip which the implement can be attached to. However, the openings only expose a limited portion of the shell and the rest remains protected and reinforced by the outer cap. In addition, the inner cap protects the liner and prevents its being punctured by the beak of the handling implement when it is inserted in one of the openings 50.

Figure 14:
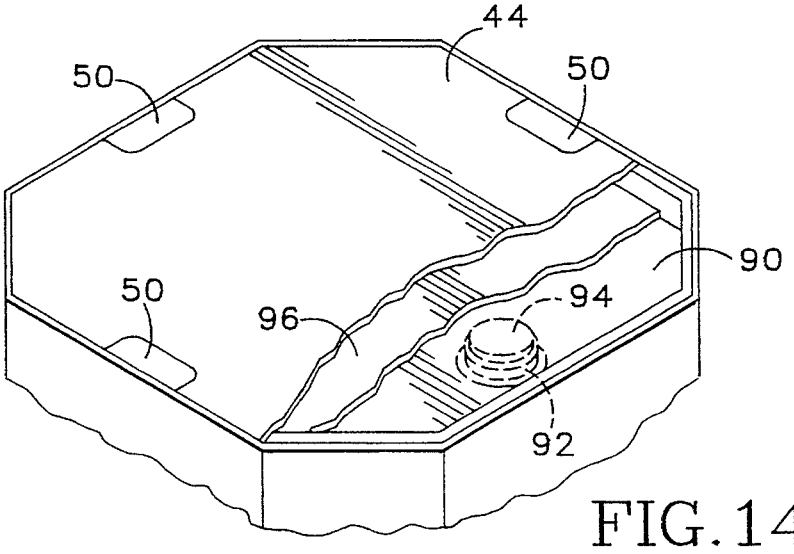
FIG. 14 is a fragmentary perspective view of a container embodying an alternate embodiment of the invention.

In an alternate embodiment of the invention, shown in FIG. 14, the polyethylene liner 22 is replaced with an aseptic liner 90 which is used for transporting food material. With aseptic liners the container is used to ship and store the material but the material is not dispensed from the container through a fitment. Instead, the aseptic liner has a cylindrical inlet 92 which is used to fill the liner, and the top of the liner is cut and the resulting edge is hung over the lip of the container to expose the material for removal. A cap 94 encloses the inlet when it has been filled. With this embodiment the inner cap 96 has no openings but is still offset from the outer cap to permit insertion of handling implements into the openings 50 in the outer cap 44. As with the previous embodiment the inner cap protects the liner from being damaged by the implement beak. In addition, the container can be opened by cutting the shell between the two caps without accidently cutting the liner.

As mentioned above, the various elements of the container of the subject invention can be shipped flat to the user so that the container can be assembled where it is to be filled. The container is assembled by inverting the outer shell piece and supporting it in its erected position. A jig comprising a block or paperboard fixture having the same shape as the erected shell will facilitate this process. The inner shell is then erected and inserted into the outer shell. When the shells are erected the base 34 is installed by inserting the flaps 38 between the inner and outer shell pieces. Adhesive may be applied to the flaps before they are inserted. The flaps 18 located at the bottom of the outer shell are folded over the base 34 and secured. If the flaps are secured with an adhesive, a strip of tape may be placed over the flaps to hold them in their folded position until the adhesive sets.

Figure 9:
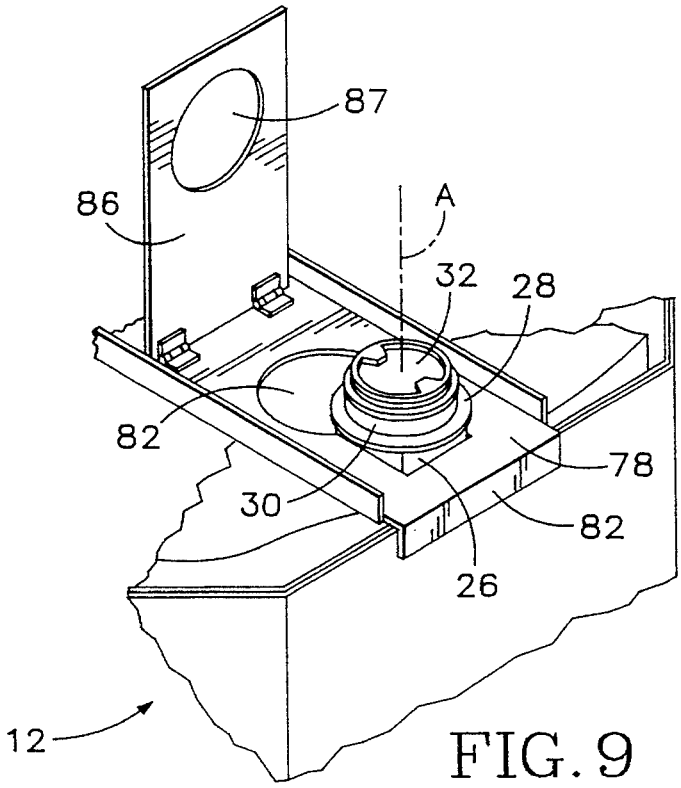
FIG. 9 is a fragmentary perspective view, similar to FIG. 6, showing a loading station which is used to fill a partially erected container.

The container is now turned over to its normal upright position and the liner is placed in it. If an aseptic liner 90 is used it can be filled before or after it is placed in the shell. If a polyethylene liner 22 is used it is placed in the shell before it is filled. The polyethylene liner can be filled either before or after the container is completed. If it is to be filled before the container is completed a filling station 76, FIG. 9, can be used to support the fitment at the top of the container during filling. The filling station comprises a bar 78 which extends across the top of the shell. Downwardly extending tabs 80 at the ends of the bar 78 engage the opposed sides of the shell to prevent movement of the filling station. A keyhole shaped opening 82 is located in the bar above the opening 48 in the outer cap. The opening 82 contains a circular portion which the flange 28 on the fitment can pass through, and a rectangular portion which snugly contacts the sides of the fitment locking portion. Thus, the fitment can be pulled through the circular portion and placed in the rectangular portion where it is prevented from dropping back into the shell. Mounted on the bar 78 on hinges 84 is a door 86 having an opening 87 formed in it that snugly engages the fitment neck 30. The door is raised, as shown in FIG. 9, while the fitment is being inserted in the opening 82 and then lowered so that the opening 87 engages the neck 30 and prevents the fitment from being displaced from the filling station.

Once the liner is filled, the caps 40 and 42 are installed to complete the process. The inner cap 40 is installed first by inserting its flaps 54 between the inner and outer shell pieces 12*a* and 12*b*. As with the base, adhesive may be applied to the flaps 54 of the inner cap before they are inserted between the shell pieces. If the liner 22 is full, the fitment 24 will project through the circular opening 58 as the inner cap is installed. If the liner is not full, the fitment will have to be pulled through the circular opening 58 when the inner cap is being installed. In either event, once the inner cap is installed the flaps 60 are folded up and the locking portion 26 of the fitment is inserted into the rectangular opening 62, FIG. 6, where it is engaged by the flaps and prevented from dropping back through the inner cap. When the inner cap is fully installed the upper edge of the spacers 52 are approximately coincident with the upper edge of the shell. However, because of the spacers 52, the center piece 56 is downwardly offset from the top edges of the shell.

Once the inner cap is in place the fitment lock 64 or 73 is installed on the fitment and may be adhesively bonded to the inner cap. Finally, adhesive may be placed on the top of the fitment lock and the outer cap 42 is placed on the container. As with the inner cap 40, adhesive may be placed on the flaps 46 before they are inserted between the shell pieces. The container is now used in much the same manner as a metal drum.

Figure 15:
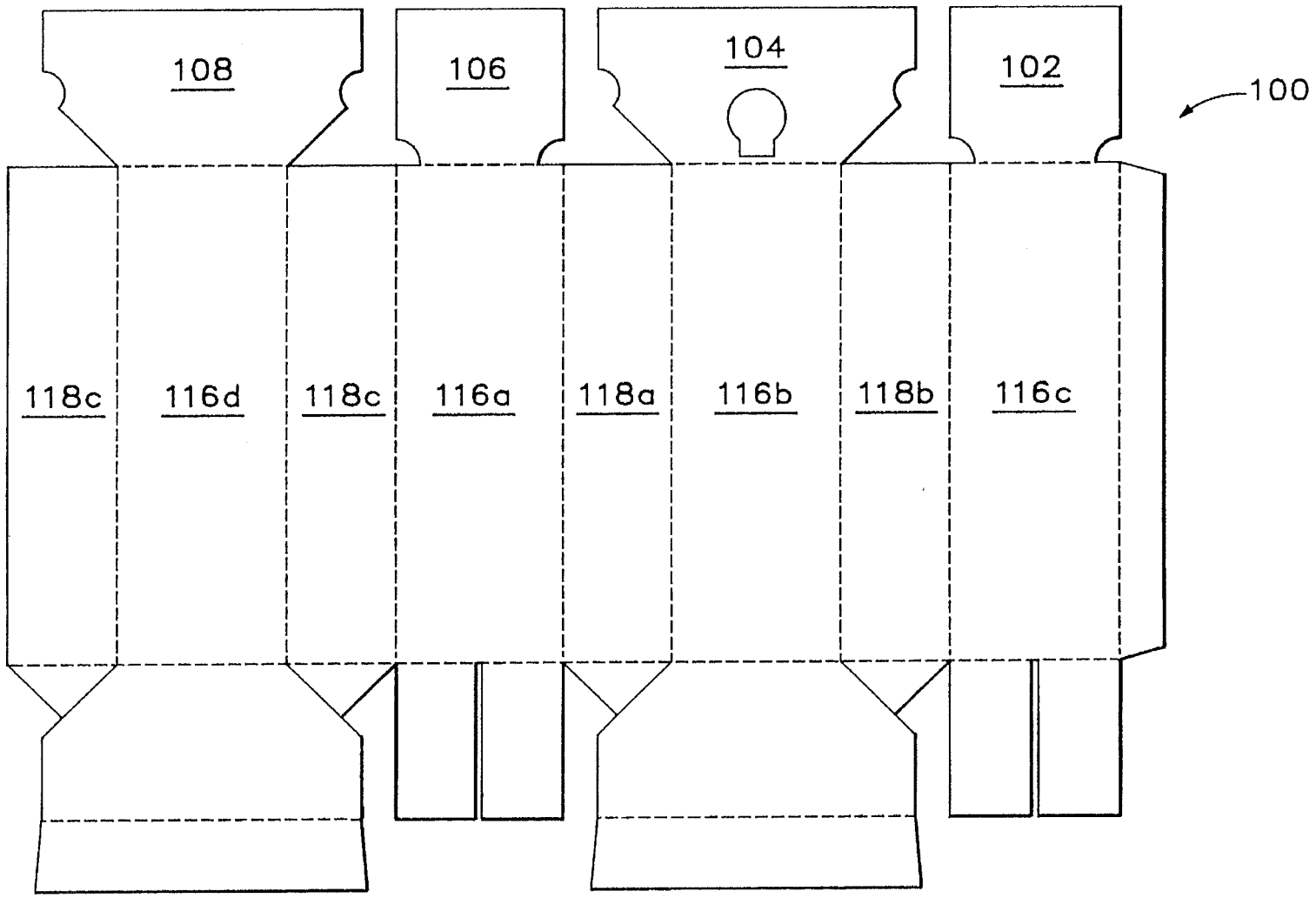
FIG. 15 is a plan view of the outer shell of an alternative embodiment of the container.
Figure 16:
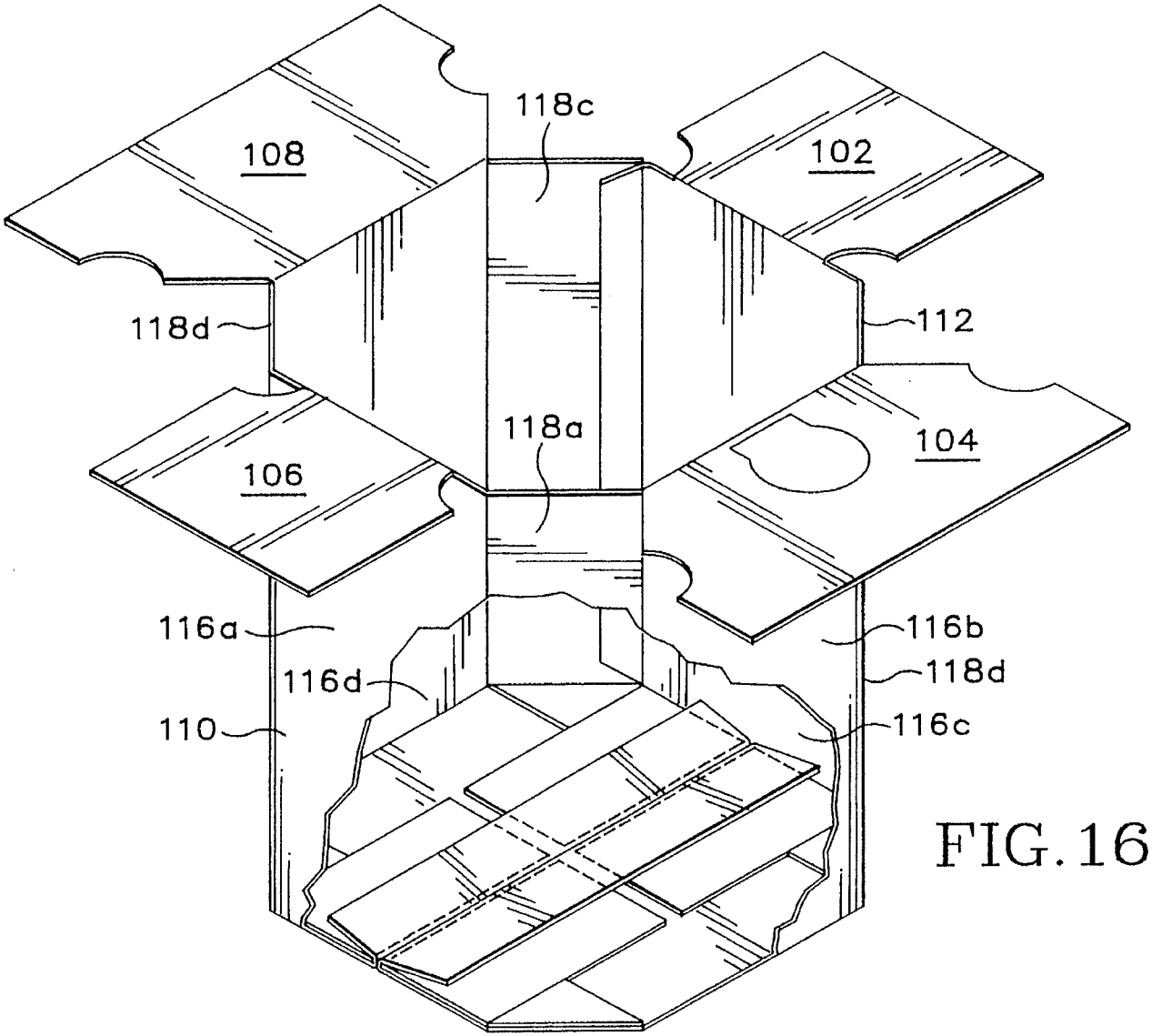
FIG. 16 is a perspective view, with a partial cutaway, of the container of FIG. 15.
Figure 17:
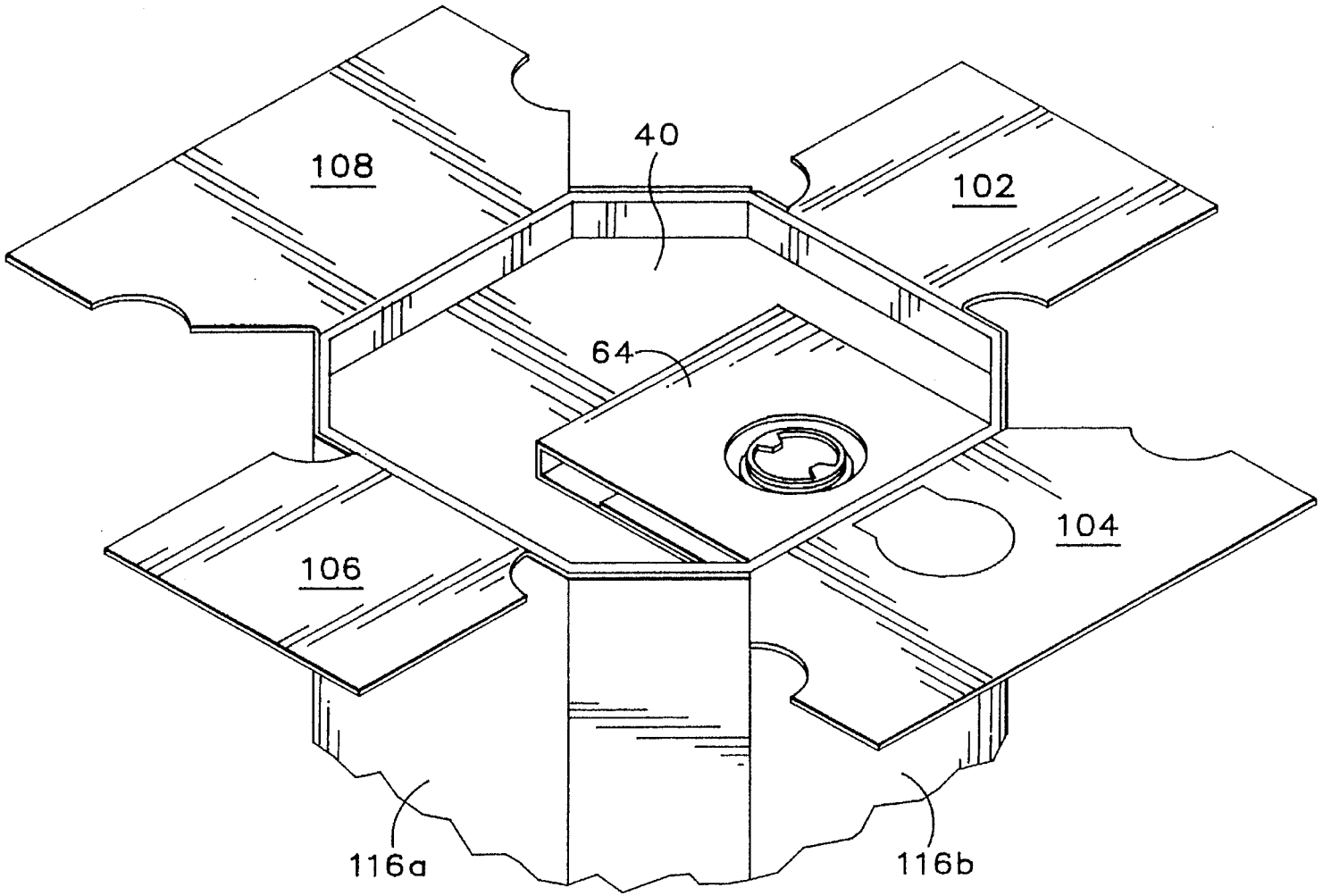
FIG. 17 is a breakaway view of the top portion of the container of FIG. 15 with an inner cap and a filament lock.
Figure 18:
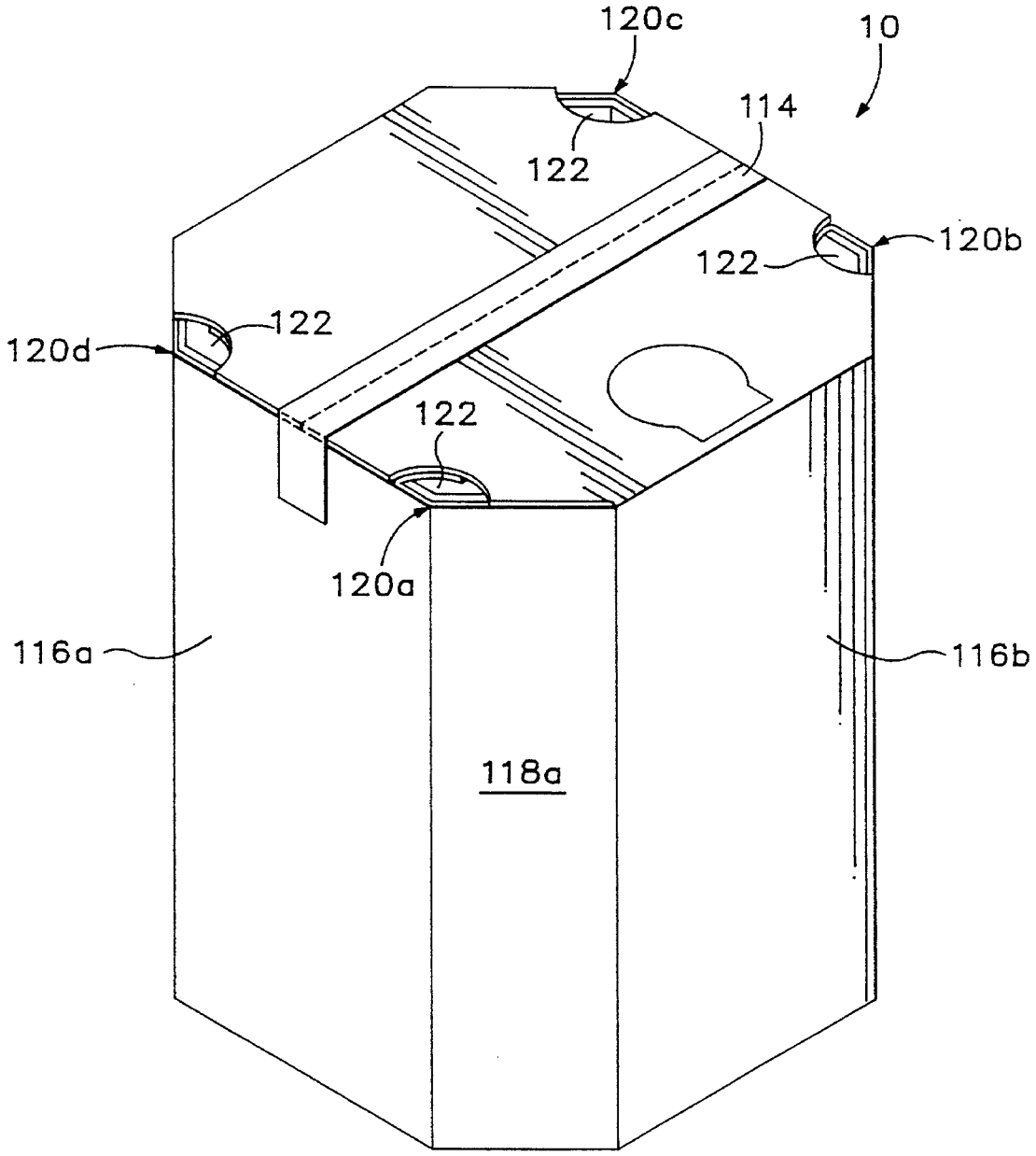
FIG. 18 is a perspective view of an assembled container of FIG. 15.

Referring to FIG. 15, an alternative embodiment of the present invention employs a modified outer shell blank 100 to eliminate the need for a separate outer cap 42. Four tabs 102, 104, 106 and 108 are incorporated on the blank 100 for the creation of a closure means to perform the same general function as the outer cap 42. Referring to FIG. 16, the outer shell 110 is initially assembled by properly folding the blank 100. After initial assembly of the outer shell 110, the top end 112 has the four outwardly extending tabs 102, 104, 106 and 108 to allow the inner cap 40 and fitment lock 64 to be positioned, as shown in FIG. 17. The tabs 102, 104, 106 and 108 are then folded together in any traditional manner, as shown in FIG. 18. Thereafter, the completed container 10 is sealed with tape 114. The use of the tabs 102, 104, 106 and 108 eliminates the need to fabricate a separate outer cap 42 and simplifies erection of the container. This closure means is also less likely to become dislodged in use.

In this alternative embodiment, the openings 50 are relocated from the wide sidewalls 116*a*, 116*b*, 116*c*, 116*d* to the corners 120*a*, 120*b*, 120*c*, 120*d*. The preferred corners 120*a*–120*d* are located on either side of two opposing wide sidewalls 116*a* and 116*c* at the junction with the narrow sidewalls 118*a*, 118*b*, 118*c* and 118*d*. It has been discovered that locating the openings 122 at corners 120*a*–120*d* makes it easier for drum handling implements to handle the cartons 10.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A container for a fluid material comprising:

(a) an upright tubular shell, having a sidewall, a top end and a bottom end;

(b) means for closing said bottom end of said shell;

(c) an inner cap which fits within said shell proximate said top end but downwardly offset therefrom;

(d) closure means for covering said top end, said closure means having at least one access opening defined therein adjacent to said sidewall of said shell; wherein (e) said inner cap is sufficiently offset from said closure means so that a drum handling implement can be inserted through said opening and engage said sidewall.

2. The container of claim 1 wherein said closure means comprises a plurality of tabs which depend from the top end of said tubular shell, said tabs being foldable to overlap one another and cover said top end.

3. The container of claim 1 further comprising:

(a) a flexible, impervious liner located within said shell between said inner cap and said bottom end;

(b) a fitment on said liner for filling and emptying said liner with a fluid material, said fitment having a cylindrical passageway with a central axis;

(c) said closure means and said inner cap having aligned passageways defined therein which allow said fitment to open out of said container; and (d) a fitment lock, located between said closure means and said inner cap, that engages said fitment, said fitment lock providing support for and preventing movement of said fitment parallel and transverse to said central axis when said fitment is loaded.

4. The container of claim 3 wherein said fitment lock bridges said closure means and said inner cap.

5. The container of claim 4 wherein said fitment lock is adhesively attached to said inner cap.

6. The container of claim 1 wherein said sidewall of said tubular shell includes at least two wide sidewall sections and a narrow sidewall section connecting said wide sidewall sections, wherein said opening is adjacent at least a portion of said narrow sidewall sections.

7. The container of claim 1 wherein said sidewall of said tubular shell includes at least two wide sidewall sections and a narrow sidewall section connecting said wide sidewall sections, wherein said opening is adjacent at least a portion of one of said wide sidewall sections.

8. The container of claim 5 wherein said fitment has a locking portion which abuts said liner, has parallel spaced-apart outer walls and is sandwiched between protruding flanges, and an annular neck portion which extends outwardly from said locking portion, and said fitment lock comprises:

(a) at least one locking flap having a rectangular slot defined therein which snugly engages said locking portion and prevents said fitment from moving in a direction parallel with said central axis relative to said fitment lock; and (b) at least one engagement flap having a hole defined therein which snugly engages said neck and prevents said fitment from moving in a direction transverse to said central axis relative to said fitment lock.

9. The container of claim 8 wherein said fitment lock is paperboard.

10. The container of claim 9 wherein said fitment lock is a single folded sheet of paperboard.

11. The container of claim 3 wherein said fitment has a locking portion which abuts said liner, has parallel spaced-apart sidewalls and is sandwiched between protruding flanges, and said fitment lock comprises a block having a width substantially equal to the distance between said protruding flanges and a rectangular slot defined therein which snugly engages said locking portion.

12. The container of claim 11 wherein said fitment lock is wood.

* * * * *